US006086307A

United States Patent [19]

Johanson

[11] Patent Number: 6,086,307

[45] Date of Patent: Jul. 11, 2000

[54] HOPPERS WITH DIRECTIONALLY APPLIED RELATIVE MOTION TO PROMOTE SOLIDS FLOW

[75] Inventor: Jerry R. Johanson, San Luis Obispo, Calif.

[73] Assignee: J R Johanson, Inc., San Luis Obispo, Calif.

[21] Appl. No.: 08/963,527

[22] Filed: Nov. 3, 1997

Related U.S. Application Data

[60] Provisional application No. 60/030,320, Nov. 4, 1996.

[51] Int. Cl.[7] ..... B65G 65/40

[52] U.S. Cl. ..... 414/288

[58] Field of Search ..... 414/288, 363, 414/375, 415, 525.7, 525.8

[56] References Cited

U.S. PATENT DOCUMENTS

| | | | |
|---|---|---|---|
| 833,761 | 10/1906 | Stevens | 414/525.7 |
| 3,747,811 | 7/1973 | Lewis et al. | 414/375 X |
| 4,068,768 | 1/1978 | Hicks, Jr. | 414/375 |
| 4,775,284 | 10/1988 | Musschoot | 198/550.01 |
| 4,999,021 | 3/1991 | Reissmann | 414/363 X |

FOREIGN PATENT DOCUMENTS

| | | | |
|---|---|---|---|
| 1288014 | 1/1969 | Germany | 414/288 |
| 2752406 | 5/1979 | Germany | 414/288 |
| 1752671 | 8/1992 | U.S.S.R. | 414/288 |

*Primary Examiner*—James W. Keenan
*Attorney, Agent, or Firm*—Daniel C. McKown

[57] ABSTRACT

An improvement to a hopper to promote the flow of solid particulate material includes mounting one or more walls of the hopper for limited oscillatory motion in a direction parallel to the wall and perpendicular to the desired flow direction, and then providing an actuator connected to the remainder of the hopper to impart such motion to the wall. The relative motion between the moving wall and the particulate material effectively rotates the friction force to the direction of relative motion, leaving the friction in the desired flow direction approaching zero. As a result, downward flow can occur on walls that are only shallowly inclined. The improvement is applicable to hopper-like structures in railroad cars and ships, where it facilitates discharge onto moving conveyors.

6 Claims, 6 Drawing Sheets

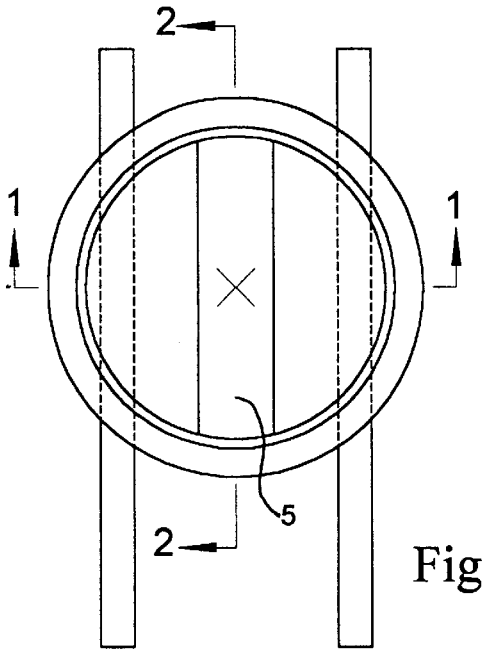
Fig. 1a
Fig. 1d
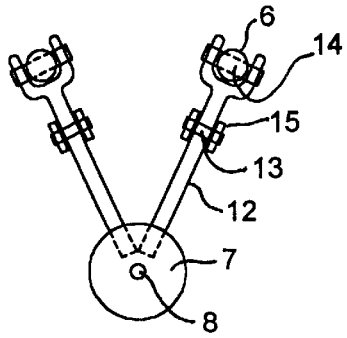
Fig. 1c
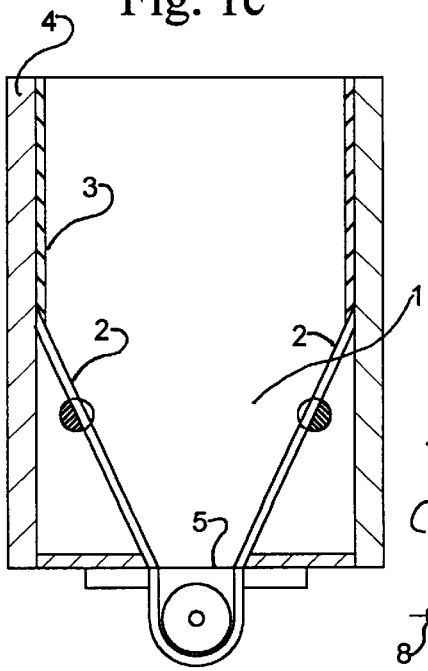
Fig. 1b
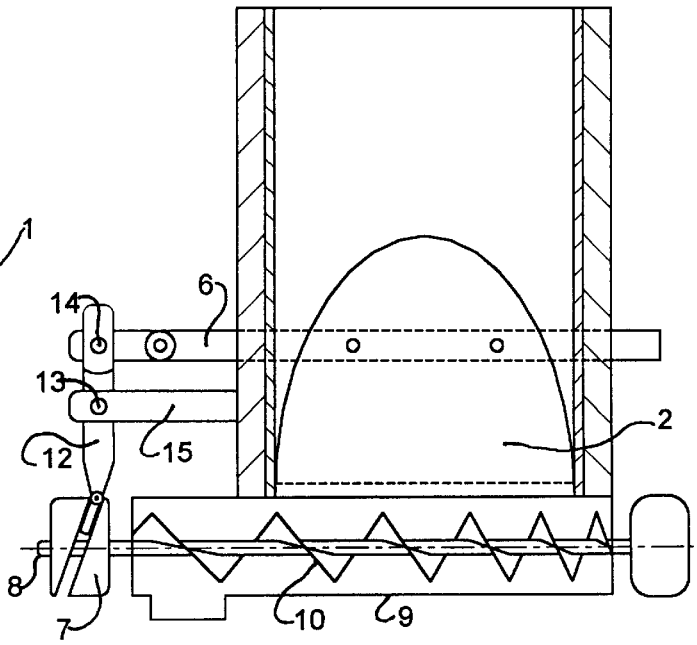

Fig. 3a
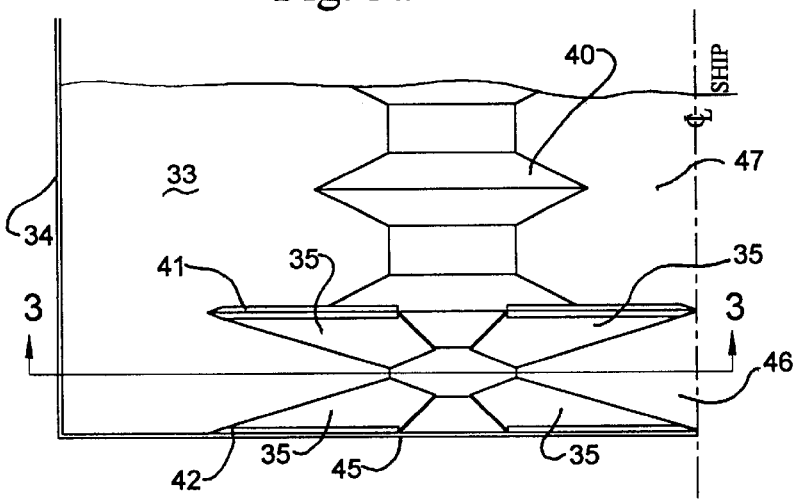
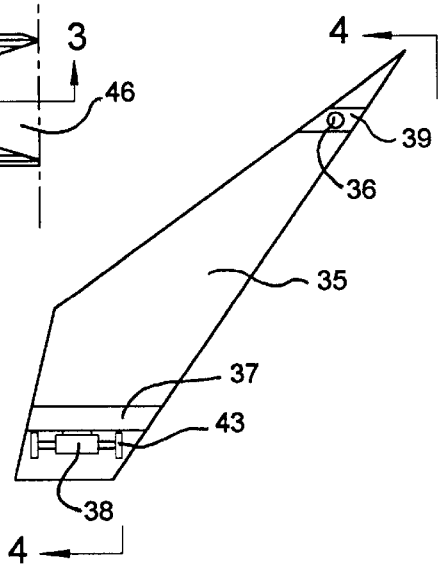
Fig. 3c
Fig. 3b
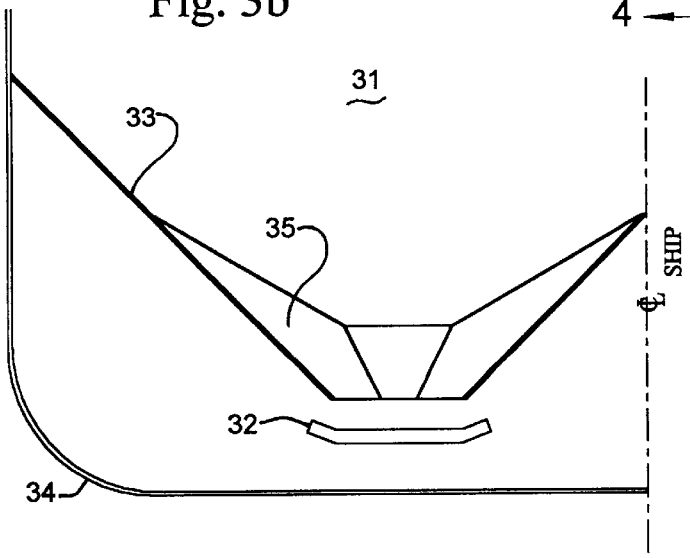
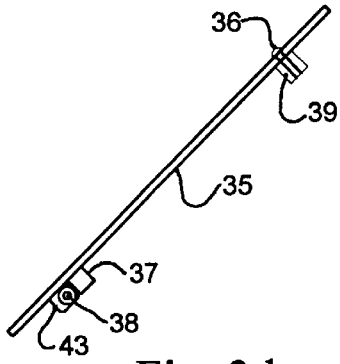
Fig. 3d

HOPPERS WITH DIRECTIONALLY APPLIED RELATIVE MOTION TO PROMOTE SOLIDS FLOW

CROSS REFERENCE TO RELATED APPLICATIONS

This application is a continuation of U.S. Provisional Patent Application Ser. No. 60/030,320 filed Nov. 4, 1996 for HOPPERS WITH DIRECTIONALLY APPLIED RELATIVE MOTION TO PROMOTE SOLIDS FLOW.

STATEMENT RE FEDERALLY SPONSORED RESEARCH OR DEVELOPMENT

Not applicable.

REFERENCE TO A "MICROFICHE APPENDIX"

Not applicable.

BACKGROUND OF THE INVENTION

Vibration has been used for years to promote flow in hoppers. The most direct approach is to hit the hopper with a sledge hammer. More sophisticated vibration techniques include: electromagnetic, air driven and motor drivers with eccentric weights. These vibrators applied directly to bins are sometimes effective in dislodging caked solids. Improvements have been made over the years by applying the vibrators to internal walls of the bins, or by suspending the entire hopper on elastic supports so that the vibration does not activate the entire structure. Most of the applied vibration is dissipated in unnecessary movement of the structure or of the solids stored within the hopper. This often causes structural damage and overcompaction of the bulk solids.

BRIEF SUMMARY OF THE INVENTION

In accordance with the present invention, discharge flow of solid particulate material from a hopper is promoted and enhanced by producing a relative motion between the particulate material and the wall along which the material is to flow. The relative motion is perpendicular to the desired direction of flow and parallel to the surface of the wall. This causes the frictional force between the material and the wall to become oriented approximately perpendicular to the desired direction of flow, with the result that friction in the direction of flow is practically zero.

In a preferred embodiment, the wall is mounted to a stationary portion of the hopper for limited motion in a direction parallel to its surface and perpendicular to the desired direction of flow. An actuator is connected to the stationary portion of the hopper and it acts upon the wall to impart the desired reciprocating motion to the wall.

This relative motion does not change the magnitude of the friction force, which remains constant and equal to the forces perpendicular to the wall times the coefficient of friction. However, the direction of the friction force always opposes the motion. In accordance with the present invention the speed of movement of the wall in its reciprocating motion is much greater than the speed of the downward flow of the particles along the wall, and therefore the direction of the friction force is approximately horizontal, and the component of the friction force in the direction of flow is approximately zero. This permits downward flow to result even when the wall is inclined at unprecedented shallow angles with respect to the horizontal.

The oscillatory motion of the wall in the present invention is very effective in breaking arches that otherwise tend to form in the material, thereby permitting the particles to flow through smaller outlets than would otherwise be possible. An additional advantage of the present invention is that motion of the wall tends to break any adhesion between the particles and the wall.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

BRIEF DESCRIPTION OF THE SEVERAL VIEWS OF THE DRAWING

FIG. 1, including FIGS. 1*a*, 1*b*, 1*c* and 1*d*, shows the application of the present invention to a chisel-shaped hopper;

FIG. 1*a* is a top plan view of a hopper to which the present invention has been applied;

FIG. 1*b* is a side elevational view in cross section of the hopper of FIG. 1*a* in the direction 2—2 indicated in FIG. 1*a;*

FIG. 1*c* is an end elevational view in cross section of the hopper of FIG. 1*a* in the direction 1—1 indicated in FIG. 1*a;*

FIG. 1*d* is a diagram showing an end view of the dual actuator of FIGS. 1*b* and 1*c;*

FIG. 2, including

FIG. 2*a* is a top plan view of the transitional hopper to which the present invention has been applied;

FIG. 2*b* is a side elevational view of the hopper of FIG. 2*a;*

FIG. 2*c* is an end elevational view of the hopper of FIG. 2*a;*

FIG. 2*d* is a perspective view of the hopper of FIG. 2*a;*

FIG. 3, including FIGS. 3*a*, 3*b*, 3*c* and 3*d*, show the application of the present invention to a self-unloading ship;

FIG. 3*a* is a fractional top plan view of a portion of a ship in which the present invention has been installed;

FIG. 3*b* is a fractional front elevational view in the direction 3—3 indicated in FIG. 3*a;*

FIG. 3*c* is a fractional oblique view of an oscillating corner plate shown in FIG. 3*b;*

FIG. 3*d* is an end view in the direction 4—4 indicated in FIG. 3*c;*

FIG. 4, including

FIG. 4*a* is a top plan view showing a multi-sided hopper in which the present invention has been installed;

FIG. 4*b* is a side elevational view of the hopper of FIG. 4*a;*

FIG. 4*c* is a perspective view of the hopper of FIG. 4*a;*

FIG. 4*d* is a fractional oblique view of the hopper in the direction 5—5 indicated in FIG. 4*b;*

FIG. 5, including

FIG. 5*a* is a top plan view of a conical hopper in which the present invention has been installed;

FIG. 5*b* is a side elevational view of the conical hopper of FIG. 5*a;*

FIG. 5*c* is a perspective view of the conical hopper of FIG. 5*a;*

FIG. 6, including FIGS. 6*a*, 6*b* and 6*c*, show the application of the present invention to a hopper having corner plates;

FIG. 6*a* is a top plan view of a hopper having corner plates in which the present invention has been installed; and, FIG. 6*b* is a perspective view of the hopper of FIG. 6*a*.

DETAILED DESCRIPTION OF THE INVENTION

Figure 2A:
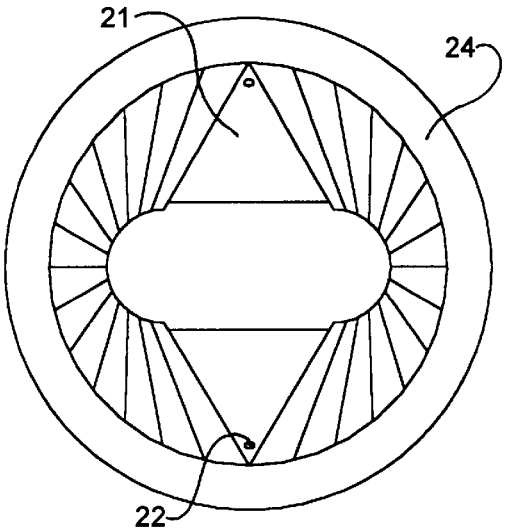
FIGS. 2*a*, 2*b*, 2*c* and 2*d*, shows the application of the present invention to a transition hopper.
Figure 2D:
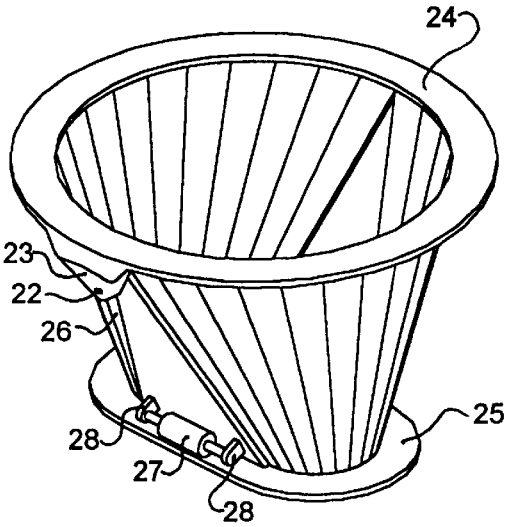
Figure 2B:
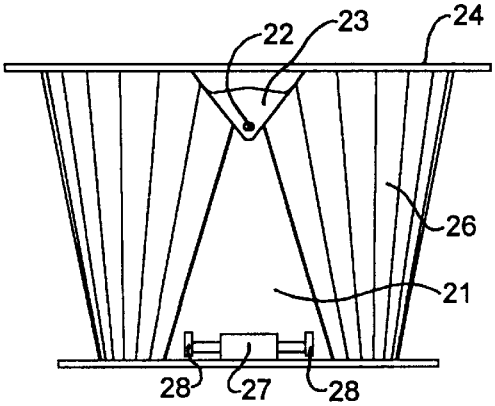
Figure 2C:
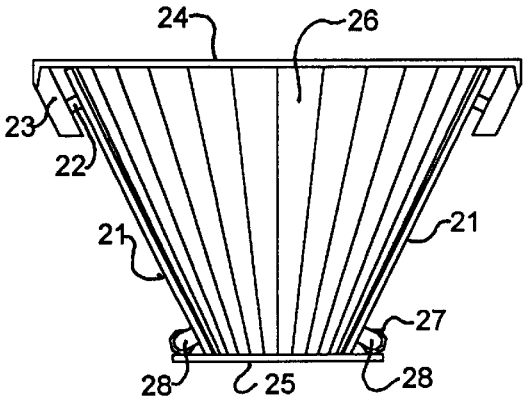
Figure 4A:
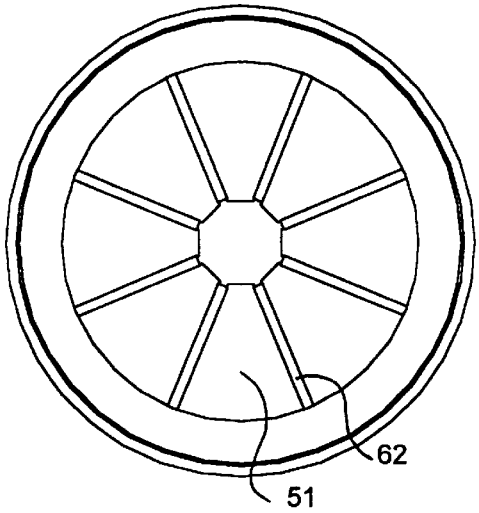
FIGS. 4*a*, 4*b*, 4*c* and 4*d*, show the application of the present invention to a multi-sided hopper.
Figure 4C:
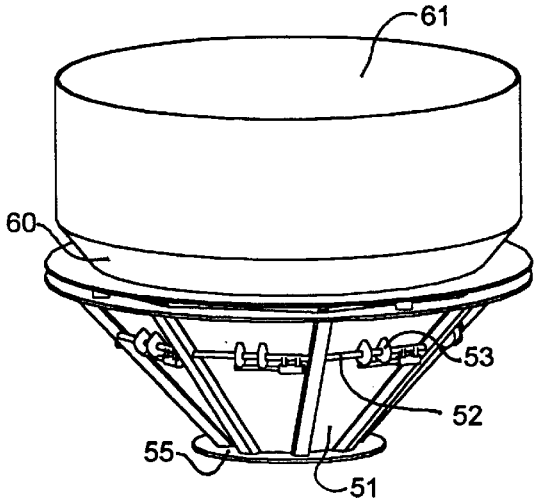
Figure 4B:
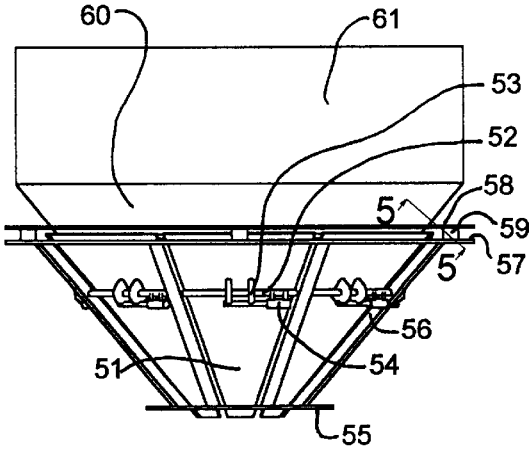
Figure 4D:
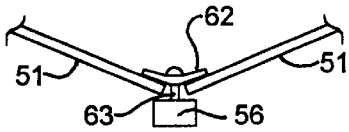

The simplest form of the invention is a section of flat side wall of a bin or hopper that is suspended in a way that it can be oscillated horizontally back and forth. This reduces the frictional component in the direction of solids flow. This simplest form is shown in FIGS. 1*a*, 1*b*, 1*c*, and 1*d* as applied to a one-dimensionally converging chisel-shaped hopper 1. The convergence is caused by two inclined pates 2 intersecting the vertical cylinder 3. The outer cylinder 4 forms the supporting structure. The two oscillating side plates 2 provide a one-dimensional convergence to a slot opening 5 equal in length to the diameter of the cylinder 4. A cylindrical insert 3 provides cover for the sloping plate edges and the cavity for the oscillation to occur. A horizontal rod 6 provides a low friction support for the oscillating walls. The oscillation is achieved by a cam 7 on the shaft 8 of the screw feeder 9 below the one-dimensional outlet. The screw 10 is equipped with a varying pitch to provide flow along the entire slot length. The oscillation occurs only as the screw turns. This avoids any overcompaction tendency by insuring that the oscillation does not occur unless the solids are removed from the hopper outlet. The turning screw activates the linkages 12 that pivot on pin 13 on stationary arm 15 and that are connected to the oscillator rod 6 by pin 14.

The disclosed invention remedies many of the pitfalls of the prior art of vibration or motion application to bins and hoppers. This invention takes advantage of gravitational forces to induce solids flow by applying a relative oscillatory motion between the solids and the hopper wall, perpendicular to the desired direction of solids flow along the walls. This reduces the surface frictional component in the direction of solids flow at sloping walls of the storage hopper. This "slick" low friction wall promotes flow along the wall and causes increased downward pressure on solids to break cohesive arches.

For this oscillatory motion to be successful, the relative motion between the solids and the wall must occur relative to the plane of the hopper and solids interface without pushing inward. This must be done because this inward push tends to overcompact the solids. The motion in the plane of the bin wall must be essentially horizontal and essentially perpendicular to the solids downward direction. This relative motion does not change the friction force magnitude, which remains constant and equal to the force perpendicular to the wall times the friction coefficient. The motion simply rotates the friction force to the direction of relative motion between the wall and the solids. When the relative horizontal motion is large with respect to the solids downward motion, the shear force direction is essentially horizontal, thus creating a very small (essentially zero) upward component of friction force acting on the solids. The solids then react as if the friction coefficient has approached zero. As a result, downward flow can occur on very shallowly inclined walls. In addition, the unsupported downward force of gravity is much more effective in breaking bridges and the solids flow through smaller outlets than without this directionally applied relative motion. Also, adhesion between the solids and the wall is broken.

Another application is a transition hopper configuration that provides a rounded end slot shown in FIGS. 2*a*, 2*b*, 2*c* and 2*d*. The end walls [6] 26 are usually very steep or even slightly expanding in the downward direction. An alternate wall suspension and activation is indicated in this application. The triangularly shaped plate 21 is primarily supported by a bracket 23 welded to the upper flange 24 and an antifriction pivot 22 near the top apex of the oscillating plate. The activation is achieved by a double acting short stroke air cylinder 27 mounted on the bottom hopper flange 25 and acting on support protrusion 28 connected to the oscillating plate 21. Intermediate antifriction supports coated with low friction bearing material such as nylon or with roller supports can be added as required structurally. As shown, flange 25 provides the outward support and guide for the oscillatory plates 21. The motion is essentially perpendicular to the direction of solids flow, especially when the magnitude of the stroke is very limited. In general, only a few millimeters movement is required to achieve the advantages of this invention. This application is further enhanced when the end walls 26 are slightly diverging downward since this further reduces support of the solids in the hopper.

A third application is shown in FIGS. 3*a*, 3*b*, 3*c* and 3*d*. In this case, two-dimensional convergence is required to feed bulk solids from a self-unloading ship hold 31 onto a conveyor 32 below. In this case, the hopper sides 33 must be shallowly inclined to maximize cargo space and to keep the cargo as low in the hold as possible. In addition, the possible structural damage from typical applied vibration may endanger the ships hull 34 and cause leaks or structural failure. The directionally applied relative motion with its oscillatory action eliminates these problems. The figure shows both a modified portion of the ship 46 and unmodified portion 47. Only the corner filler plates 35 are oscillated around an upper pivot point 36. The oscillating plate is supported by the cross beam 37 and activated by the double acting cylinder 38 at the bottom. The cylinder acts against protrusions 43 from the oscillating plate 35. This minimizes the force and requires only one antifriction surface location. The pivot support 39 located near the top allows for the smallest force for activation at the more critical hopper outlet location. The oscillating corner plates 35 provide the low effective friction in the most critical regions. The plates are sealed against significant solids intrusion under them by a flexible strip 39 attached to the underside of the oscillating plate 35. This attachment to the oscillating plate has the advantage of scraping the stationary plates 33 and 40 and thereby loosening solids adhered to the stationary plates, thus aiding flow on these stationary plates. The upper edge of the oscillating plates are protected by an angular-shaped cover 41 that prevents solids intrusion behind the oscillating plates. At a vertical bulkhead 45 the closure can be effected by either the flexible strip 39 or a cover plate 42 that is essentially half of the angular cover 41. With some materials the oscillating plates will work satisfactorily without the cover angles or the flexible strips.

The fourth application, shown in FIGS. 4*a*, 4*b*, 4*c* and 4*d*, is a series of oscillating flat plates 51 connected to form a converging hopper. The example shown is a symmetric octangular configuration, although symmetric or nonsymmetric configurations of three or more sides are also viable applications. The plates 51 are shown oscillating on a single support guide 52 although multiple guides can be used if they are required for additional structural support. The material seal between oscillating plates 51 is accomplished by a single flexible strip 62 bearing against adjacent oscillating plates 51. The strip is secured by bolts 63 to the support 56. The top seal is accomplished by a protruding the lower edge of the upper stationary hopper 60 below and within the upper edges of the oscillating plates 51 (a cone-shaped hopper 60 is used in the example shown). This upper stationary hopper 60 has the advantage of relieving loads on the oscillating plates 51 thereby reducing both structural support and oscillatory force requirements. Flow in this upper region is usually not critical so that a stationary hopper is completely satisfactory. This is especially true if the ratio of bottom cone 60 diameter to top cylinder 61 diameter is 0.7 or greater. The oscillation is achieved by either a reciprocating pneumatic or hydraulically driven piston, or a linear motion vibrator 54 attached from the support rods 52 or the major support beams 56 and acting against the plate supports 53. The lower solids seal is achieved simply by extending the oscillating plates 51 to below the lower support ring 55.

By varying the amount of oscillation (either frequency or amplitude or both) to the oscillating plates, the relative solids velocity of the center and outside can be varied. The control of the flow pattern allows the hopper to serve as an adjustable gravity flow blender. The blending can be enhanced by varying the oscillation around the periphery of the hopper thus causing a variation in flow from one side to the other.

Figure 5A:
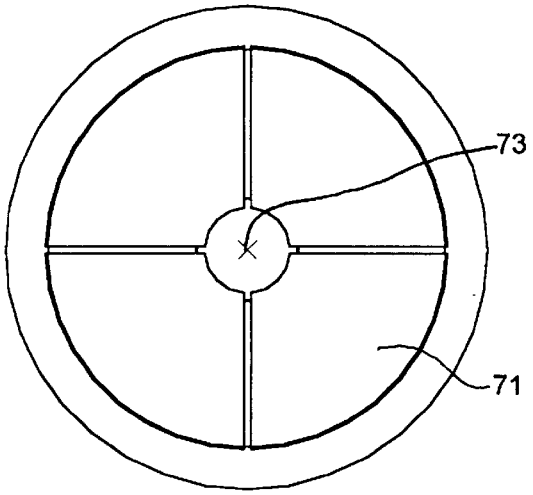
FIGS. 5*a*, 5*b* and 5*c*, show the application of the present invention to a section of a conical hopper.
Figure 5C:
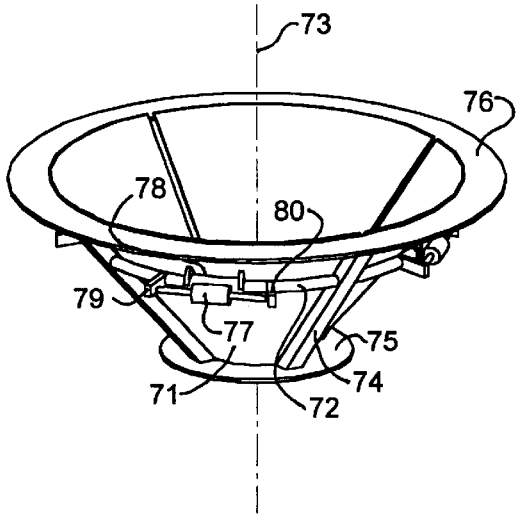
Figure 5B:
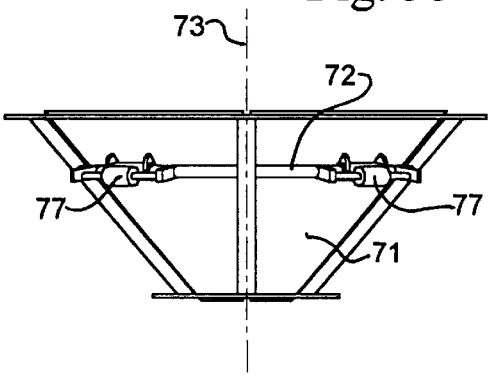

The next slightly more complicated application is shown in FIGS. 5*a*, 5*b*, and 5*c*, wherein motion is applied to a conical hopper section 71. In this case, the supports 72 should be arranged so that the movement is around the axis of symmetry 73 of the conical section 71.

The curved support rods 72 are connected to the supports 74 that are in turn connected to the lower flange 75 and upper flange 76. In this embodiment the oscillation is achieved by attaching the actuator 77 to the hopper antifriction support bearing 78 and allowing the actuator 77 to act against the two protruding supports 79 and 80 attached to the support rod 72. The additional support required to stabilize the conical section 71 is achieved by allowing the conical section 71 to rest against either the lower flange 75 or the upper flange 76. This support could be replaced by rollers with axes parallel to the conical surface and attached to flanges 75 or 76 if further friction reduction is desired. The same solids seal arrangement as shown in FIG. 4 is used in FIG. 5. Similarly this FIG. 5 configuration can be used to modulate the flow pattern in the hopper. The same concept of oscillation can be used for circular cones with nonvertical axes.

Figure 6A:
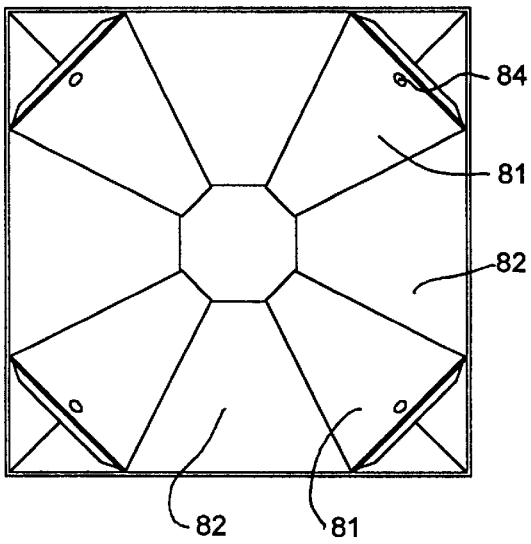
Figure 6B:
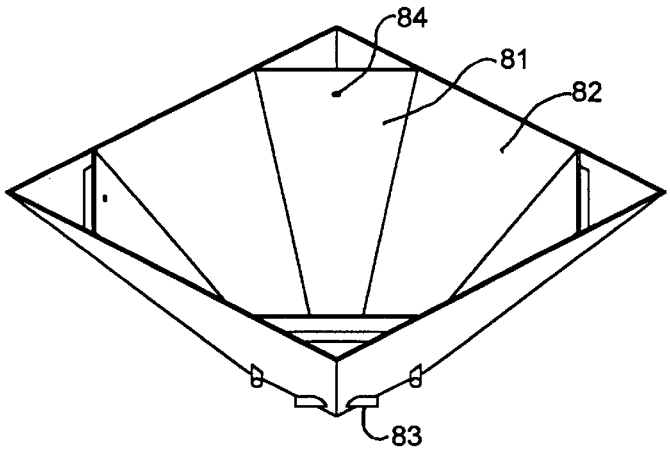

Another application is a retrofit of a pyramid-shaped hopper shown in FIGS. 6*a* and 6*b*. The corner formed by the flat plates 82 are covered and activated by plates 81. These activated plates 81 are supported by a corner mounting that provides a support pivot 84 near the top of the plate. The activation and support is achieved by the rod 83 attached to plate 81 and protruding from the corners of plates 82 at the bottom. Activation can be achieved simply by striking rod 83 with a hammer first on one end then the other. This manual activation eliminates the need for a linear actuator and allows the operator to strike the hopper without effectively damaging the structure. Note that in general there will be a vertical section on the hopper and the plate 81 will extend into the corner above the hopper and seal solids from getting behind the plate 81. This embodiment can be effective with or without the flexible seals shown in FIG. 3.

I claim:

1. A hopper that actively promotes the flow of particulate material through itself, comprising:

a stationary member;

a movable exterior hopper wall having an inwardly-facing surface along which the particulate material flows downwardly;

means for coupling said movable exterior hopper wall to said stationary member for limited oscillatory motion in a direction perpendicular to the direction of flow, said limited oscillatory motion having no component perpendicular to said movable exterior hopper wall; and, means connected to said stationary member and to said movable exterior hopper wall for moving said movable exterior hopper wall in limited oscillatory motion in said direction.

2. The hopper of claim 1 wherein said movable exterior hopper wall is conical and has an axis of symmetry, and wherein said means for moving drives said movable exterior hopper wall in rotational oscillatory motion about said axis of symmetry.

3. The hopper of claim 1 further comprising a circular upper edge and a discharge opening that is bounded by two parallel straight edge sections alternating with semicircular edge sections, whereby said hopper includes two planar triangular portions having the straight edge sections as bases, and wherein said movable exterior hopper wall is one of said two planar triangular portions.

4. The hopper of claim 1 further comprising inclined planar wall portions that converge downwardly to a discharge opening, and wherein said movable exterior hopper wall is one of said inclined planar wall portions.

5. The hopper of claim 1 further comprising inclined planar wall portions that converge downwardly to opposite sides of a discharge slot, and wherein said movable exterior hopper wall is one of said inclined planar wall portions.

6. The hopper of claim 1 wherein said means for coupling is a pivot having an axis perpendicular to said movable exterior hopper wall, and wherein the limited oscillatory motion consists of rotational oscillatory motion about said axis.

* * * * *